US010052647B2

(12) United States Patent
Diebel

(10) Patent No.: US 10,052,647 B2
(45) Date of Patent: Aug. 21, 2018

(54) NOZZLE ASSEMBLY WITH SELF-CLEANING FACE

(71) Applicants: Andritz Inc., Glens Falls, NY (US); ANDRITZ Küsters GmbH, Krefeld (DE)

(72) Inventor: Manifred Diebel, Nidderau (DE)

(73) Assignees: ANDRITZ INC., Alpharetta, GA (US); ANDRITZ KÜSTERS GMBH, Krefeld (DE)

( * ) Notice: Subject to any disclaimer, the term of this patent is extended or adjusted under 35 U.S.C. 154(b) by 0 days.

(21) Appl. No.: 15/036,542

(22) PCT Filed: Jan. 16, 2015

(86) PCT No.: PCT/US2015/011686
§ 371 (c)(1),
(2) Date: May 13, 2016

(87) PCT Pub. No.: WO2015/112436
PCT Pub. Date: Jul. 30, 2015

(65) Prior Publication Data

US 2016/0296960 A1 Oct. 13, 2016

(30) Foreign Application Priority Data

Jan. 21, 2014 (DE) ..... 10 2014 100 605

(51) Int. Cl.
*B05B 15/55* (2018.01)
*B05B 7/10* (2006.01)
(Continued)

(52) U.S. Cl.
CPC ..... *B05B 15/55* (2018.02); *B05B 1/28* (2013.01); *B05B 7/068* (2013.01); *B05B 7/10* (2013.01);
(Continued)

(58) Field of Classification Search
CPC ..... B05B 7/068; B05B 15/0258; B05B 1/005; B05B 7/10; B05B 15/025; B05B 15/0431; D21G 7/00; D21H 23/50; B05D 1/02
(Continued)

(56) References Cited

U.S. PATENT DOCUMENTS 2,572,538 A * 10/1951 Teters ..... B60S 3/047 239/326
3,581,998 A * 6/1971 Roche ..... E03C 1/046 239/310
(Continued)

FOREIGN PATENT DOCUMENTS

EP 2223748 9/2010
EP 2647760 10/2013
(Continued)

*Primary Examiner* — Steven J Ganey
*Assistant Examiner* — Steven M Cernoch
(74) *Attorney, Agent, or Firm* — Kerri A. Hochgesang; Robert Joseph Hornung

(57) ABSTRACT

A nozzle assembly with a self-cleaning face is provided, having a nozzle body with a liquid flow path defined therethrough with an inlet and a spray outlet. The nozzle body is mounted in a carrier body, and an annular gas flow channel is located about the nozzle body with a gas discharge outlet defined around the spray outlet. A porous surface is located about the annular gas flow channel at the gas discharge outlet. A radiused surface is formed in the carrier body at the air discharge outlet. A pathway is in communication with the porous surface and adapted to provide a low velocity fluid discharge from the porous surface. A spray device and method are also provided using the nozzle assembly with the self-cleaning face. An adaptor for retrofitting an existing nozzle is also provided.

12 Claims, 9 Drawing Sheets

(51) Int. Cl.

| | |
|---|---|
| ***D21H 23/50*** | (2006.01) |
| ***D21G 7/00*** | (2006.01) |
| ***B05B 7/06*** | (2006.01) |
| ***B05D 1/02*** | (2006.01) |
| ***B05B 1/28*** | (2006.01) |
| ***B05B 12/18*** | (2018.01) |
| ***B05B 15/555*** | (2018.01) |

(52) U.S. Cl.
CPC ..... *B05B 15/555* (2018.02); *B05D 1/02* (2013.01); *D21G 7/00* (2013.01); *D21H 23/50* (2013.01); *B05B 12/18* (2018.02)

(58) Field of Classification Search
USPC ..... 239/326, 590, 590.3, 553, 553.3, 239/398–434.5
See application file for complete search history.

(56) References Cited

U.S. PATENT DOCUMENTS 3,637,141 A * 1/1972 Gores ..... A61C 17/02 239/326
4,210,534 A * 7/1980 Molvar ..... B01F 3/0446 210/220
4,341,348 A * 7/1982 Dearling ..... A61L 9/12 239/326
4,502,629 A * 3/1985 McGhee ..... B05B 5/03 239/11
4,890,791 A * 1/1990 Hoffman ..... A61L 9/127 239/326
4,976,607 A * 12/1990 Grimard ..... F23C 5/06 239/422
5,656,084 A 8/1997 Focke et al.
5,845,846 A 12/1998 Watanabe et al.
5,932,293 A 8/1999 Belashchenko et al.
6,269,821 B1 * 8/2001 Berke ..... A45D 34/04 132/317
6,474,569 B1 * 11/2002 Brundish ..... F15C 1/08 239/404
6,716,484 B2 * 4/2004 Brynolf ..... C08J 7/12 427/255.25
6,866,207 B2 3/2005 Kangas et al.
6,969,012 B2 11/2005 Kangas et al.
7,124,574 B2 * 10/2006 Horn ..... F02K 9/52 239/398
7,967,221 B2 * 6/2011 Snyder ..... B05B 7/0416 239/418
8,789,769 B2 * 7/2014 Fenton ..... A62C 31/02 239/422

FOREIGN PATENT DOCUMENTS

| | | |
|---|---|---|
| JP | 2002-102765 | 4/2002 |
| JP | 2002102765 | 4/2002 |
| WO | 9003225 | 4/1990 |
| WO | 9411116 | 5/1994 |
| WO | 2004056487 | 7/2004 |

* cited by examiner

NOZZLE ASSEMBLY WITH SELF-CLEANING FACE

FIELD OF THE INVENTION

The invention relates to a self-cleaning nozzle for use in a spray apparatus to apply a dispersed fluid to a moving web in a web forming process. Motive fluid delivered to an annular flow channel at the nozzle face imparts a helical swirl to process liquid delivered via a central spray outlet, thereby dispersing and uniformly distributing it onto a web moving through the spray apparatus.

BACKGROUND OF THE INVENTION

The invention concerns a self-cleaning nozzle particularly suitable for use in a plurality in a spray apparatus for the application of a fluid, such as a liquid suspension of starch, binder, adhesive, colorant or other material such as a surface coating agent, onto at least one surface of a paper web in a papermaking process.

In the manufacture of paper, board and similar cellulosic products, a fluid stock consisting of from about 1% solids suspended in about 99% water is ejected at high speed and precision from a headbox slice onto a moving forming fabric, or between two fabrics, in the forming section of a papermaking machine. The stock is drained through the fabric or fabrics by gravity and/or vacuum so that, by the end of the forming section, a cohesive nascent web of fibers is provided. This web is then transferred to a downstream press section where further water removal occurs by mechanical means as the web, together with one or more press fabrics is passed through at least one, and usually a series, of nips formed between pairs of rotating press rolls so as to remove a further portion of the water entrained in the web. At the end of the press section, the web is transferred to the dryer section where its remaining moisture is removed by evaporative means as it is passed, together with one or more dryer fabrics, over a series of steam heated rotating drums known as dryer cans or cylinders.

The paper product thus obtained will usually require at least one or more subsequent chemical or physical treatments so as to render it suitable for its intended use and impart to it various properties, such as smoothness, gloss, impermeability, rigidity, color, and so on, as desired. These properties are often obtained by applying a surface sizing agent or other material (such as a colorant, optical brightener, or water resistant film or other coating) during or following drying. This is frequently done by passing the sheet through a pond sizer so that it is immersed in the desired solution, or by applying size as a film using a film sizing apparatus as the sheet passes through a nip. In addition, it is often necessary to apply water onto the sheet so as to improve the uniformity of the moisture content across the full width of the manufactured web.

A wide variety of both pond and film sizing application devices are available on the market today, and numerous patents cover various aspects of their technology. Although suitable for use in certain applications, the known devices are limited in machine speed potential and cannot exceed these limits without causing process instabilities, or web breaks to occur due to strength losses and/or absorbency variations in the web that is delivered to the sizing apparatus. It is also difficult to precisely control the average amount of material applied to the sheet independently of machine speed with the known devices, and the specific amount applied at different locations across the full width of the manufactured web. As well, the known devices are difficult to keep clean.

It has been found that one means of overcoming at least a portion of the aforementioned problems of the known film or pond coating methods is to spray the desired process liquid directly on to the sheet as it passes beneath or through one or more arrays of spray nozzles. Both the average amount and the cross-directional uniformity of spray application are less dependent on sheet properties than by conventional application means, and it is also possible to use relatively high concentrations of suspended or dissolved materials in the process liquid. In addition, a spray apparatus allows for more precise control of the amount, and type, of materials to be delivered as the liquid and solids concentration provided to at least a portion of the nozzles can be proportioned to allow for a somewhat profiled delivery to the sheet. However, a problem common to the known spray apparatuses is that it is difficult to keep the nozzle areas clean and free of contaminants, particularly where a sizing material is being applied. Typically, the solids in the process liquid will become deposited proximate the nozzle tip, and their build up will eventually disrupt the spray pattern and clog the nozzle outlet.

Nozzles for spraying a dispersed mist onto a moving web, and arrangements of such nozzles, are well known, and have been described, for example, by Sundholm et al. EP 435904 and EP 682571; Kangas et al. U.S. Pat. No. 6,866,207 and U.S. Pat. No. 6,969,012; and Diebel et al. EP 2 223 748. Others are known and used.

Tynkkynen et al. EP 2 647 760 describes a nozzle in which the tip or end is provided with means for controlling its temperature so as to prevent or at least minimize the adherence of undesirable matter from the fluid spray that is applied to the moving web. However, this is a high pressure type nozzle with a small tip opening, and the solution proposed in the disclosure is not appropriate to nozzles having a relatively larger spray opening at the tip, where the process liquid is dispersed by a flow of pressurized air.

None of the known prior art effectively addresses the issue of preventing deposits of the sprayed material and/or contaminants being formed around the nozzle discharge outlet that affects the spray dispersion quality as well as the spray pattern.

SUMMARY OF THE INVENTION

In order to address the issue of preventing deposits for nozzles, particularly of the type having a nozzle body with a liquid flow path defined therethrough having an inlet and a spray outlet, with a carrier body that surrounds the nozzle body having an annular gas flow channel with a gas discharge outlet located around the spray outlet, according to the invention a porous surface, preferably in the form of a porous disk, is provided that surrounds the annular gas flow channel at the gas discharge outlet. A low velocity fluid is delivered to the porous surface and is discharged therethrough to minimize deposition of undesirable matter adjacent the spray outlet. A radiused surface is formed in the carrier body around the air discharge outlet where it acts to decompresses a motive fluid to assist in uniformly dispersing process liquid delivered to the spray outlet, as well as provides a radially outwardly expanding flow to the porous surface, keeping this transition area free of deposits. This can be incorporated into new nozzles or provided by an adapter for existing nozzles.

In a first preferred embodiment, a nozzle assembly with a self-cleaning discharge end face is provided having a nozzle body with a liquid flow path defined therethrough having an inlet and a spray outlet. A carrier body is provided in which the nozzle body is mounted, and an annular gas flow channel is defined around the spray outlet that is provided with a source of pressurized fluid. A porous surface is located on the face of a discharge end of the nozzle assembly, and is in fluid communication with a preferably annular pathway. The porous surface is adapted to provide a low velocity fluid discharge of the pressurized fluid delivered to the annular pathway. A radiused surface is formed in the carrier body around the air discharge outlet where it acts to decompresses a motive fluid so that it expands the flow outwardly to the porous surface. This arrangement reduces or prevents the deposition of spray material and contaminants around the discharge end of the spray nozzle, minimizing the need to shut down a production line for cleaning and/or replacement of the spray nozzles by providing a nozzle with a self-cleaning face provided with a low velocity fluid discharge that prevents deposition of contaminants about the spray outlet.

In the first preferred embodiment, a motive fluid such as a pressurized gas is provided to an air path in the nozzle assembly from an outside source and then passes through a stator where angled guide vanes impart a helical swirling motion to the fluid flow. As a first portion of the motive fluid proceeds downstream towards the discharge end though an annular gas flow channel, it is compressed due to a tapering of the channel from a larger cross-sectional area upstream to a smaller cross-sectional area proximate the spray outlet downstream. Process liquid is separately supplied to the liquid flow path via an inlet. As the motive fluid emerges from the gas flow channel, it passes over the radiused surface and exits at the gas discharge outlet where it decompresses, thereby atomizing and, via the rotary motion imparted to it, dispersing the process liquid delivered to the spray outlet to ensure uniform deposition of liquid droplets onto a surface of a moving web to which it is to be applied during use. A second portion of the motive fluid entering the annular gas flow channel is diverted into and delivered via at least one radial channel to the annular pathway which is in fluid communication with a porous disk. A portion of this motive fluid passes through the porous disk and provides a low velocity fluid discharge as it exits the disk through its porous surface thereby removing contaminants and other matter before they become deposited on or around the porous surface and the spray outlet. The flow of motive fluid over the radiused surface also provides a radially outwardly expanding flow to the porous surface, keeping this transition area free of deposits. In this embodiment, a portion of the motive fluid supplied to the annular gas flow channel downstream of the stator is also directed to the annular pathway via the radial channel(s).

In a second preferred embodiment, the motive fluid is provided to the air path in the nozzle assembly from an outside source. A first portion passes through the stator where angled guide vanes impart to it a helical swirling motion; this motive fluid then proceeds downstream towards the discharge end along the annular gas flow channel where it is compressed due to a tapering of the channel from a larger cross-sectional area upstream to a smaller cross-sectional area proximate the spray outlet downstream. Process liquid is separately supplied to the liquid flow path via the inlet. As the motive fluid emerges from the gas flow channel at the gas discharge outlet, it passes over a radiused surface where it decompresses, thereby atomizing and, via the rotary motion imparted to it, dispersing the process liquid delivered to the spray outlet to ensure uniform deposition of droplets of process liquid onto a surface of the moving web to which it is to be applied when in use. A second portion of the motive fluid entering the air path is separately directed to at least one air inlet. From the inlet, this motive fluid proceeds along at least one outside channel to the preferably annular pathway which is in fluid communication with the porous disk. A portion of this motive fluid passes through the porous disk and provides a low velocity fluid discharge as it exits the disk through the porous surface so as to remove contaminants and other matter before they become deposited on or around the porous surface and the spray outlet. The flow of motive fluid over the radiused surface also provides a radially outwardly expanding flow to the porous surface, keeping this transition area free of deposits. Thus, in this second embodiment of the invention, a portion of the motive fluid delivered to the nozzle is directed via the air inlet and separate outside channel(s) to the annular pathway prior to or separately from passing through stator, while in the first embodiment, the motive air is directed through the stator to annular gas flow channel where a portion is then directed to the annular pathway via the radial channel(s).

In a third preferred embodiment of the invention, a first motive fluid is delivered under pressure from an external source to an air path in the nozzle from which it passes through the stator to the annular gas flow channel. As the motive fluid emerges from the channel, it passes over the radiused surface where it decompresses as it exits the nozzle at gas discharge outlet, thereby atomizing and, via the rotary motion imparted to it by stator, uniformly disperses process liquid delivered to the spray outlet via the inlet so as to ensure uniform deposition of liquid droplets onto a surface of the moving web to which it is to be applied. A second fluid is separately supplied to the air inlet via an external fluid inlet. This second fluid may be the same as, or different from, the first motive fluid supplied to the air path from the external source. This second fluid moves from the air inlet along the outside channel to a preferably annular pathway, and then through the porous disk to provide a low velocity fluid discharge over the porous surface so as to remove contaminants and other matter before they become deposited on or around the porous surface and the spray outlet. The flow of motive fluid over the radiused surface also provides a radially outwardly expanding flow to the porous surface, keeping this transition area free of deposits.

In this third embodiment of the invention, the second fluid supplied to the porous disk via the external fluid inlet is provided separately from the first motive fluid supplied to the stator via the air path, and thus may be the same as, or different from, that fluid. For example, the fluid delivered to the external fluid inlet may be a cleaning agent, steam or otherwise. In this embodiment, the supply of second fluid to the porous disk may be provided either continuously or intermittently as it may be separately controlled from the supply of the first motive fluid. By comparison, the fluid delivered to the porous disk in the first and second embodiments must always be the same as the motive fluid provided to the air pathway.

In a fourth preferred arrangement of the invention, a nozzle adaptor is provided which is structured and arranged so as to be located in surrounding engagement with a nozzle housing including a nozzle assembly which may either be an air & liquid type such as described previously, or a high pressure nozzle, either of which may be used in the application of an atomized fluid in a web forming process. The adaptor includes an adaptor body in which is located a nozzle assembly receptacle opening that is adapted to be a close surround fit over the nozzle housing including the nozzle assembly and the outlet. The adaptor is separately supplied with a fluid, such as a cleaning solvent, or a gas such as steam, damp or humid air, or ambient air, via an adaptor inlet. The fluid delivered via the adaptor inlet is directed to a fluid inlet to an outside channel in fluid communication with a preferably annular pathway and is delivered from there to a porous surface, preferably a porous disk, located in surrounding relation to the opening where it provides a low velocity fluid discharge through porous surface. The opening is sized to accommodate a spray outlet including a liquid flow path of the nozzle assembly. As mentioned, the nozzle assembly is provided with a separate source of motive fluid shown diagrammatically as provided through the fluid path while a process liquid is delivered from an external source via the inlet via a liquid flow path. The adaptor preferably also includes the radiused surface about the discharge outlet for the motive fluid to promote a radially outwardly expanding flow to the porous surface, keeping a transition area between the discharge outlet and the porous surface free of deposits. The adaptor allows for retrofitting of a wide variety of nozzles with the features of the self-cleaning face of the present invention, including nozzles which were not originally constructed to incorporate them, including, but not limited to, nozzles that do not use motive air for process liquid dispersion. In this embodiment, it is possible to provide a fluid (such as a liquid cleaning agent) or a gas (such as air, steam, or damp/humid/ambient air) to the porous disk separately from any motive fluid that may be provided to disperse process liquid. Such fluid can be provided as needed to the porous disk as it is separately supplied.

In the first, second and third embodiments of the invention, the nozzle assembly preferably includes a stator located in the annular gas flow channel. The stator preferably includes a series of guide vanes oriented at an angle to the process liquid flow path so that a helical rotary swirling motion is imparted to it as the liquid passes under pressure through angled vanes in stator.

Preferably, the air path is in communication with a source of pressurized motive fluid that creates an active fluid flow on the porous surface. Alternatively, the porous surface is supplied with a pressurized fluid via an external fluid inlet.

Preferably, the pressurized motive fluid is directed to the porous disk downstream of the stator. Alternatively, the motive fluid is directed to the porous disk via a fluid inlet channel located upstream of the stator.

Preferably, the annular pathway is provided with a motive fluid selected from a gas and a liquid. Preferably, the motive fluid is damp air which creates an active fluid flow on the porous surface.

In another aspect, the invention provides a spray assembly for a liquid, which includes a liquid chamber adapted to contain liquid to be sprayed, a fluid chamber adapted to contain pressurized fluid, and a plurality of nozzles connected to the chamber. Each of the nozzles includes: a nozzle body with a liquid flow path defined therethrough having an inlet and a spray outlet a carrier body in which the nozzle body is mounted; a preferably annular pathway defined around the spray outlet that is provided with a source of pressurized fluid; and a porous surface located on the face of discharge end and in fluid communication with the annular pathway; the porous surface is adapted to provide a low velocity fluid discharge from the pressurized fluid delivered to the annular pathway at the porous surface. The annular pathway is connected to the air path or an outside channel to provide a low velocity fluid discharge through the porous surfaces surrounding the nozzles that prevents deposition of contaminants about the spray outlets of the nozzles.

In another aspect, the invention provides a method of spraying a liquid on an object, which includes the steps of:

i. providing a spray assembly including a liquid chamber for liquid to be sprayed;

ii. providing at least one nozzle including a nozzle body with a liquid flow path defined therethrough having an inlet and a spray outlet, the inlet being in fluid communication with the liquid chamber, a carrier body in which the nozzle body is mounted, with a preferably annular pathway defined around the spray outlet that is provided with a source of pressurized fluid; a porous surface located on the face of discharge end and in fluid communication with the annular pathway; the porous surface adapted to provide a low velocity fluid discharge from the pressurized fluid delivered to the annular pathway at the porous surface; and a radiused surface is formed in the carrier body around the air discharge outlet where it acts to decompresses a motive fluid to assist in uniformly dispersing process liquid delivered to the spray outlet, as well as provides a radially outwardly expanding flow to the porous surface, keeping this transition area free of deposits;

iii. spraying liquid from the liquid chamber through the nozzle while simultaneously supplying pressurized fluid to the porous surface creating a low velocity fluid discharge from the porous surface, with the fluid transported through the porous surface keeping a discharge end surface of the nozzle clean.

Further features and embodiments of the invention are described below and in the claims, which are expressly incorporated into this Summary section, and have not been reproduced here for the sake of brevity.

BRIEF DESCRIPTION OF THE DRAWINGS

The foregoing summary, as well as the following detailed description of the preferred embodiment of the present invention will be better understood when read in conjunction with the appended drawings. For the purposes of illustrating the invention, there is shown in the drawings two embodiments which are currently preferred. It should be understood, however, that the invention is not limited to the precise arrangements shown. The invention will now be described with reference to the appended Figures in which.

DETAILED DESCRIPTION OF THE PREFERRED EMBODIMENTS

Figure 1:
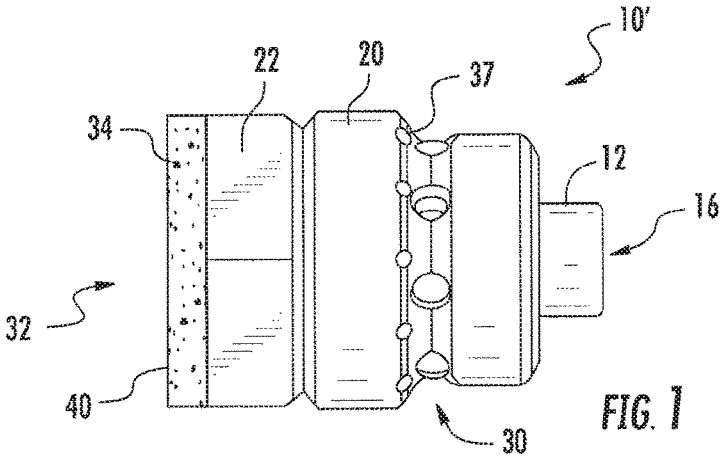
FIG. 1 is a lateral side view of a nozzle assembly according to an embodiment of the invention.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of the nozzle. "Stator" refers to a fixed set of guide vanes located in air path 30 oriented to impart helical motion to the fluid. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIG. 1, a lateral external side view of a nozzle assembly 10' according to a second embodiment of the invention is provided. Nozzle assembly 10' is essentially the same as assembly 10 with the exception of air inlets 37 which are not present in the nozzle assembly 10 of the first embodiment as will be discussed below in relation to FIG. 4. The assembly 10' includes a nozzle body 12 surrounding liquid flow path 14 (FIGS. 4-7) which is supplied with a process liquid, for example a starch suspension, via inlet 16. Nozzle body 12 is in turn surrounded by a carrier body 20 which preferably includes a tool engaging surface 22. The carrier body 20 further includes air inlets 37 which, in a second and third embodiment, provide access (not shown) to a source of pressurized motive fluid, such as a cleaning liquid (e.g. acetone), a gas, ambient or damp/humid air or other preferably gaseous fluid to one or more outside channels 39 (FIGS. 5 & 6) located interior to carrier body 20 as will be discussed below. An air path 30, including a plurality of exterior air inlet openings 37 arranged radially around carrier body 20 provide access for a gas such as ambient or humid/damp air. A porous disk 40 is located at end face 34 of carrier body 20 at discharge end 32 of the nozzle assembly 10 opposite the inlet 16.

Figure 2:
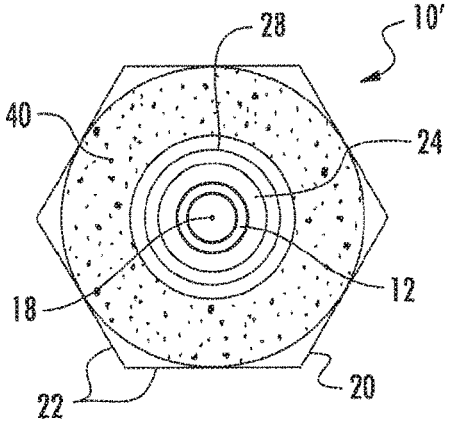
FIG. 2 is a top view of the nozzle assembly provided in FIG. 1.

FIG. 2 is a top view of nozzle assembly 10, 10' and 10" looking down onto porous disk 40 which, when in use, will face towards the paper product or other web of material to be sprayed. As shown in FIG. 2, porous disk 40 is located in surrounding relationship to spray outlet 18 of nozzle body 12. Interior to the porous disk 40 and immediately adjacent spray outlet 18 is located annular gas flow channel 24 surrounding which is a radiused surface 28. The carrier body 20 with the tool engaging surfaces 22 allow for insertion and removal of nozzle assembly 10 into the nozzle housing 1 and apparatus for which it is intended.

Figure 3:
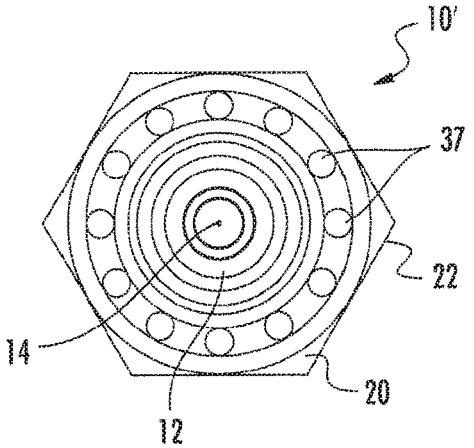
FIG. 3 is a bottom view of nozzle assembly 10 as it would appear ready for connection to a housing in a spray assembly such as shown in FIGS. 10 and 11.
Figure 10:
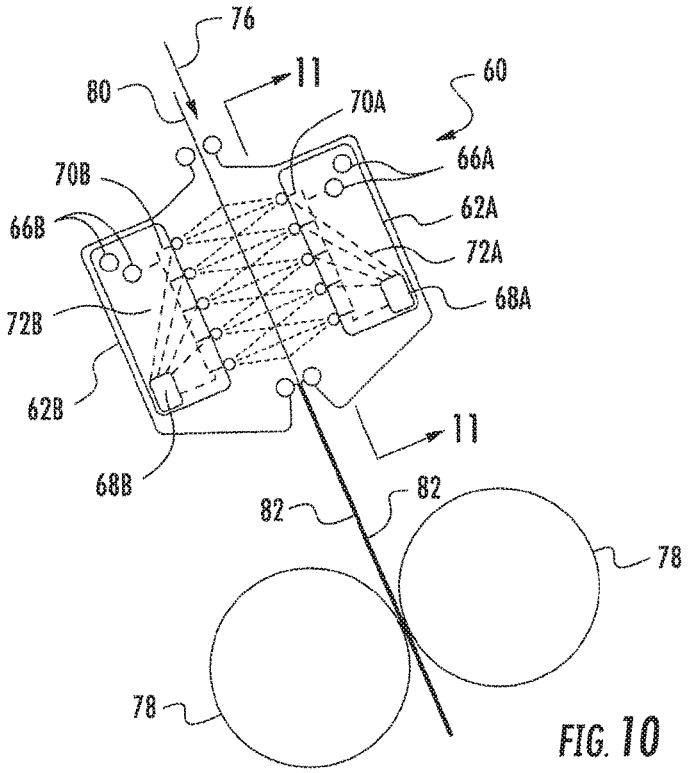
FIG. 10 is a schematic representation of a spray assembly including a plurality of self-cleaning nozzles according to the embodiments of the invention.

FIG. 3 is an illustration of the inlet, or connection end, of nozzle assembly 10' shown in FIG. 1 as oriented for attachment in a spray apparatus 60 (FIG. 10). This view shows the assembly 10' which includes the nozzle body 12 which is continuous with and surrounds liquid flow path 14. The air inlets 37 to the outside channels 39 (FIGS. 5 & 6) are enclosed within the carrier body 20, and the tool engaging surfaces 22 which allow for installation and removal of nozzle assembly 10' in a nozzle housing and spray apparatus can be clearly seen. The air inlets 37 to the outside channels 39 are in communication with a source of pressurized fluid and provide a passageway to the porous disk 40 for delivery of a low velocity fluid discharge at the opposing nozzle end of the nozzle assembly 10'.

Figure 4:
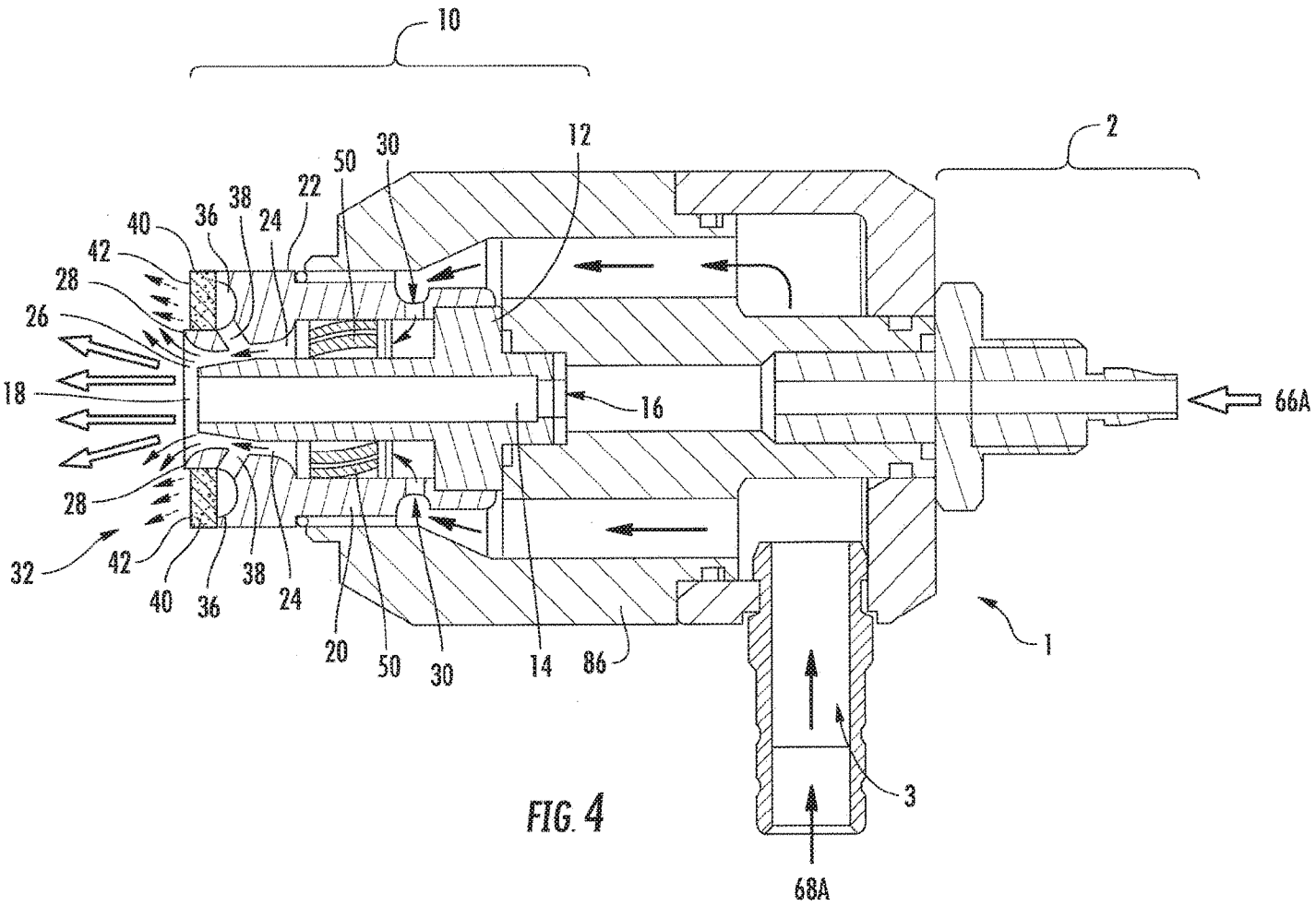
FIG. 4 is a cross-section taken along a plane through the central axis of the self-cleaning nozzle assembly shown in FIGS. 1 to 3 according to a first embodiment of the invention and as attached to a nozzle housing 1.

FIG. 4 provides a cross-sectional view of a first embodiment of nozzle assembly 10 taken along a plane through its longitudinal center axis. Beginning at the right of FIG. 4, nozzle assembly 10 is located in nozzle housing 1 including coupling 2 which, when in use, is connected to a source of process liquid that is delivered to inlet 16 of liquid flow path 14 surrounded by the carrier body 12 of nozzle assembly 10. A motive fluid is delivered from a fluid chamber 68A (FIG. 10) via external source 3 through housing 1 to air path 30.

A stator 50 is located in surrounding relation to nozzle body 12 interior to carrier body 20 and in communication with the air path 30. Motive fluid such as ambient or hot damp air is delivered under pressure from the air path 30 to the stator 50 and then to the annular gas flow channel 24. As shown in detail in FIGS. 12 to 14, the stator 50 includes angled guide vanes 52 which impart a helical swirling motion to the fluid delivered by the air path 30, causing it to swirl and rotate about the longitudinal axis of the nozzle body as it enters the annular gas flow channel 24.

The cross-sectional dimension of annular gas flow channel 24, thus its volume, progressively decreases from the stator 50 to a minimum prior to the radiused surface 28 and then increases rapidly at the gas discharge outlet 26. This initial volume decrease compresses the spinning fluid delivered through the angled guide vanes of the stator 50; the fluid then rapidly decompresses as it passes over radiused surface 28 at the gas discharge outlet 26. This rapid decompression of the fluid, in combination with the helical swirling motion imparted by the guide vanes 52 of the stator 50, causes the fluid to effectively explode outwardly as it exits the outlet 26. Process liquid delivered to the spray outlet 18 via the liquid flow path 14 is completely atomized and uniformly dispersed by the explosive effect created by the rapid expansion of the swirling fluid as it exits gas discharge outlet 26 surrounding spray outlet 18.

In this first embodiment of the invention, a first portion of the fluid delivered to air channel 24 from upstream stator 50 is directed to gas discharge outlet 26 to disperse the process liquid, while a second portion of the motive fluid entering channel 24 is diverted into radial channel 38 from which it passes to a preferably annular pathway 36 in fluid communication with porous disk 40. A portion of this motive fluid passes through porous disk 40 and provides a low velocity fluid discharge as it exits the disk 40 through porous surface 42, thereby removing contaminants and other matter before they become deposited on or around porous surface 42 and spray outlet 18. The radiused surface 28 also promotes a radially outwardly expanding flow to the porous surface 42, keeping this transition area free of deposits. Thus, in this embodiment, a portion of the motive fluid supplied to annular gas flow channel 24 downstream of stator 50 is also directed to annular pathway 36 via radial channel 38.

Figure 5:
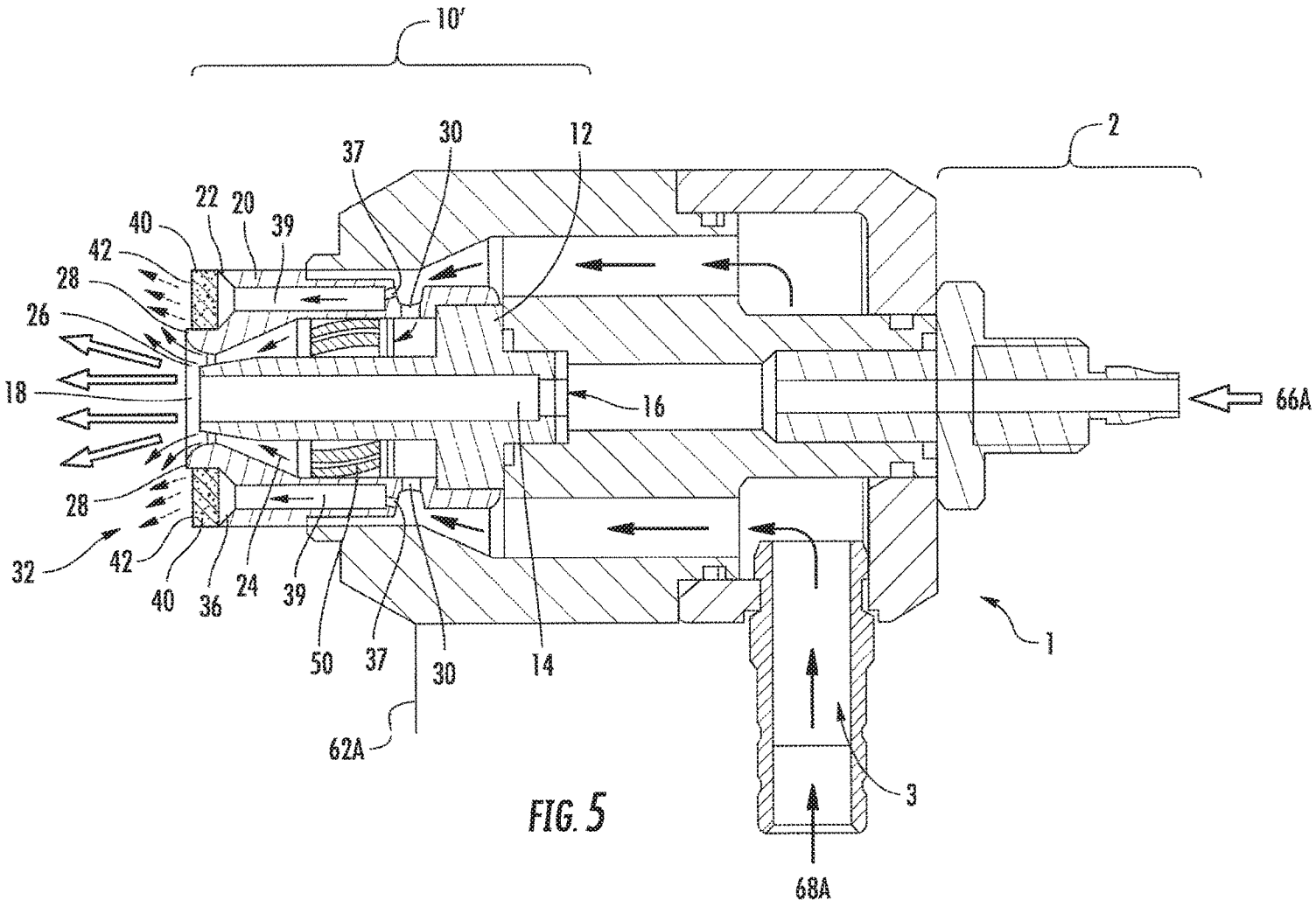
FIG. 5 is a cross-sectional illustration of a self-cleaning nozzle assembly according to a second embodiment of the invention.

FIG. 5 provides a cross-sectional view of a second embodiment of a nozzle assembly 10' taken along a plane through its longitudinal center axis; aspects of this embodiment are illustrated in FIGS. 1 through 3, previously discussed. The main difference between the nozzle assembly 10' shown in FIG. 5 and the assembly 10 shown in FIG. 4 is the presence of outside channels 39. Beginning at the right of FIG. 5, nozzle assembly 10' is located in nozzle housing 1 which includes coupling 2 connected to a source of process liquid that is delivered to inlet 16 from liquid chamber 66A (FIG. 10), proceeds along liquid flow path 14 surrounded by the carrier body 12 connected to housing 1 through which motive air is delivered via external source 3 from fluid chamber 68A (FIG. 10) to air path 30.

A stator 50 is located in surrounding relation to nozzle body 12 interior to carrier body 20 and in communication with the air path 30 to which a first portion of a motive fluid, such as ambient or hot damp air, is delivered under pressure. This motive fluid passes through the stator 50 and then to the annular gas flow channel 24. As shown in detail in FIGS. 10-12, the stator 50 includes angled guide vanes 52 which impart a helical swirling motion spinning motion to the fluid delivered by the air path 30, causing it to swirl and rotate about the longitudinal axis of the nozzle body as it enters the annular gas flow channel 24. As previously discussed, the cross-sectional dimension of annular gas flow channel 24, thus its volume, progressively decreases from the stator 50 causing the moving fluid delivered over the radiused surface 28 to effectively explode outwardly as it exits the outlet 26, causing process liquid delivered to the spray outlet 18 via the liquid flow path 14 to be uniformly dispersed.

A second portion of the same motive fluid entering air path 30 is separately directed to air inlet 37 and does not pass through stator 50. From inlet 37, this motive fluid proceeds along outside channel 39 to a preferably annular pathway 36 which is in fluid communication with porous disk 40. A portion of this motive fluid passes through porous disk 40 and provides a low velocity fluid discharge as it exits through porous surface 42 which assists in preventing deposition of contaminants adjacent the nozzle. Again, the radiused surface 28 also promotes a radially outwardly expanding flow to the porous surface 42, keeping this transition area free of deposits. Thus, in this second embodiment of the invention, a first portion of the motive fluid delivered to nozzle 10' is directed through the stator 50 to annular gas flow channel 24, and a second portion of the motive fluid delivered to nozzle 10' is directed via air inlet 37 and separate outside channel 39 to the annular pathway 36 and does not pass through stator 50.

Figure 6:
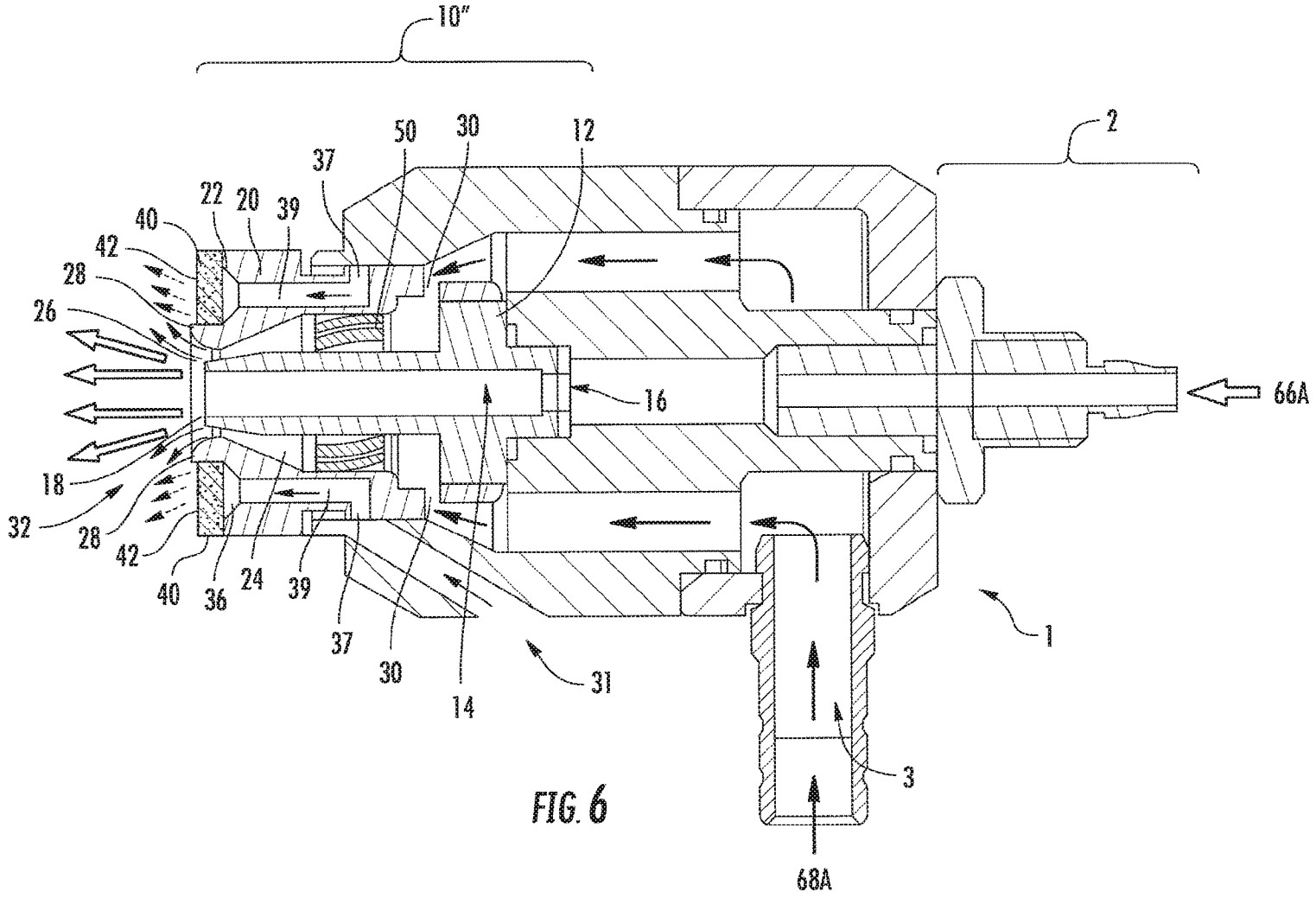
FIG. 6 is a cross-sectional illustration of a self-cleaning nozzle assembly according to a third embodiment of the invention.

FIG. 6 is a cross-sectional representation of a nozzle assembly 10" according to a third embodiment of the invention and which is taken along a plane through the longitudinal center axis of the assembly. The main difference between the nozzle assembly 10" shown in FIG. 6 and the assembly 10' shown in FIG. 5 is the presence of external fluid inlet 31 which allows for delivery of a separate fluid to the nozzle assembly 10" as will be discussed in detail below.

Beginning at the right of FIG. 6, nozzle assembly 10" is located in nozzle housing 1 which includes coupling 2 connected to a source of process liquid such as 66A (FIG. 10) that is delivered to inlet 16 and proceeds along liquid flow path 14 surrounded by the carrier body 12 and supported by the stator 50 within the carrier body 20 around which nozzle housing 1 is adapted to fit and exits assembly 10" at the spray outlet 18. A source of motive fluid 3 is connected to housing 1 from fluid chamber 68A and this fluid is delivered to air path 30. The stator 50 is located in fluid communication with the air path 30 and includes a plurality of angled guide vanes 52. When a motive fluid such as such as ambient or hot damp air is delivered under pressure by the air path 30 to the stator 50, the angled guide vanes 52 impart a helical swirling motion to the gaseous fluid, causing it to rotate about the longitudinal axis of the nozzle body as it enters the annular gas flow channel 24 surrounding the nozzle body 12. The fluid is directed towards the gas discharge outlet 26 where it is progressively compressed as it moves from the stator 50 along the channel 24 towards the radiused surface 28. This is because the cross-sectional dimension of the annular gas flow channel 24, and thus its volume, decreases as it approaches the radiused surface 28, then expands rapidly at the gas discharge outlet 26, thereby decompressing the fluid. As the fluid exits outlet 26, it expands rapidly and assists to atomize and uniformly disperse process liquid delivered by the liquid flow path 14 onto a moving web such as 80 (FIG. 10).

In this embodiment, a second fluid is separately supplied under pressure to air inlet 37 via external fluid inlet 31. This second fluid may be the same as, or different from, the motive fluid supplied to air path 30 from external source 3. This second motive fluid moves from air inlet 37 along outside channel 39 to a preferably annular pathway 36, and then through porous disk 40 to provide a low velocity fluid discharge as it exits through porous surface 42 which assists in preventing deposition of contaminants adjacent the nozzle. The radiused surface 28 here also promotes a radially outwardly expanding flow to the porous surface 42, keeping this transition area free of deposits.

It will be appreciated that, in this third embodiment of the invention, the second fluid supplied to the porous disk 40 via external fluid inlet 31 is provided separately from the first motive fluid supplied to the stator 50 via the air path 30, and thus may be the same as, or different from, that fluid. For example, the fluid delivered to external fluid inlet 31 may be a cleaning agent, steam, ambient air, or otherwise and may be provided to the annular pathway (and the porous disk 40) either continuously or intermittently as this supply may be separately controlled. By comparison, the fluid delivered to the porous disk 40 in the first and second embodiments shown in FIGS. 4 and 5 must always be the same as the motive fluid provided to air pathway 30.

Figure 7A:
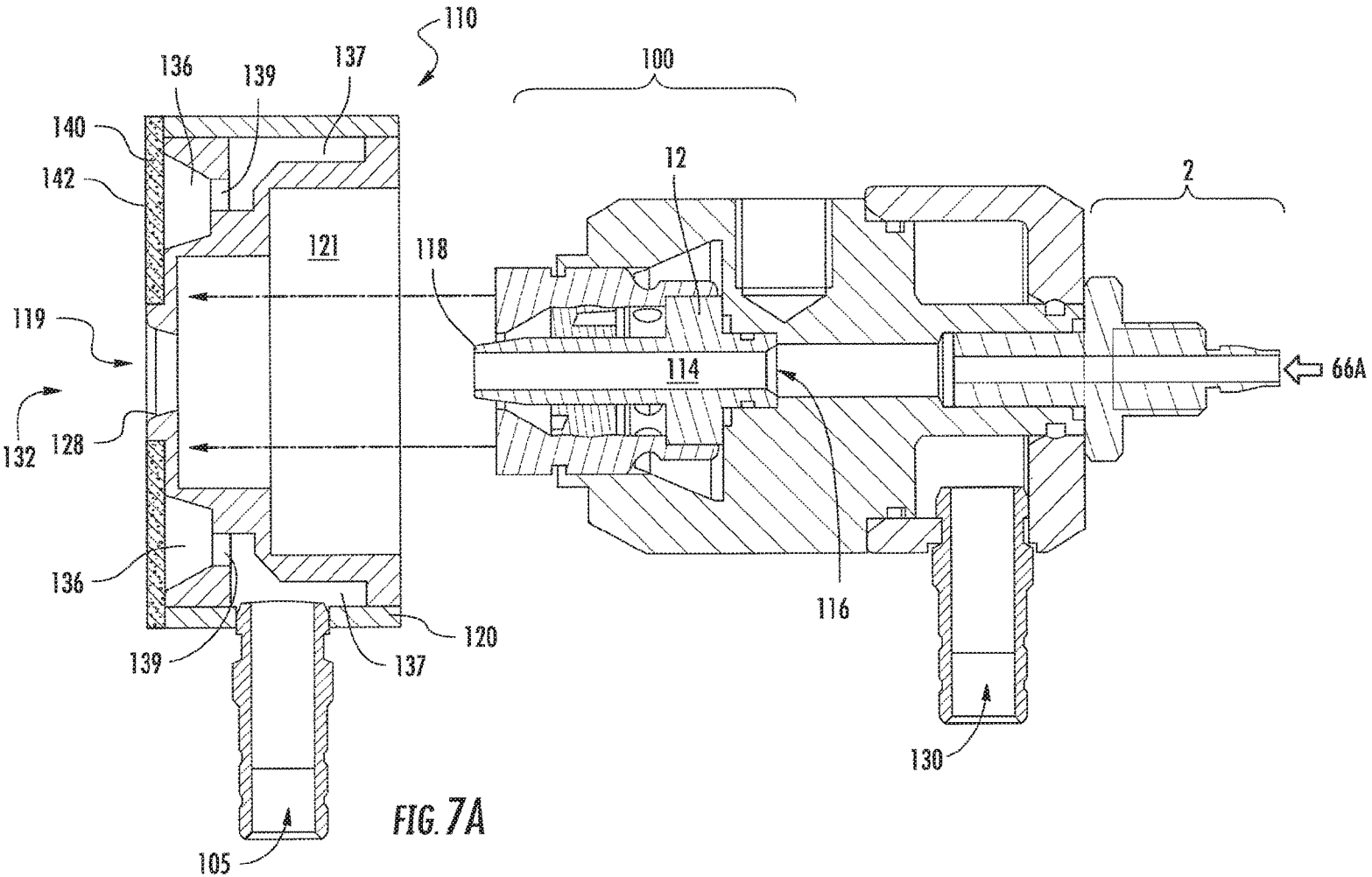
FIGS. 7A-C are cross-sectional side views, showing a partially disassembled adaptor and nozzle (FIG. 7A), an assembled adaptor and nozzle (FIG. 7B), and an enlargement of the nozzle opening (FIG. 7C), illustrating an adaptor for converting an existing nozzle into a self-cleaning nozzle according to the invention.
Figure 7C:
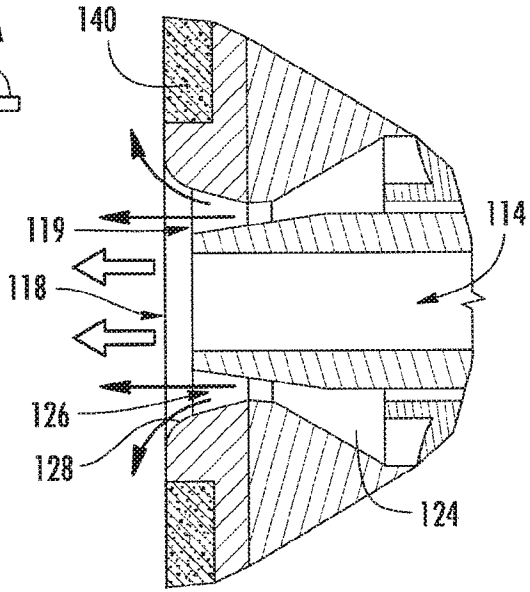
Figure 7B:
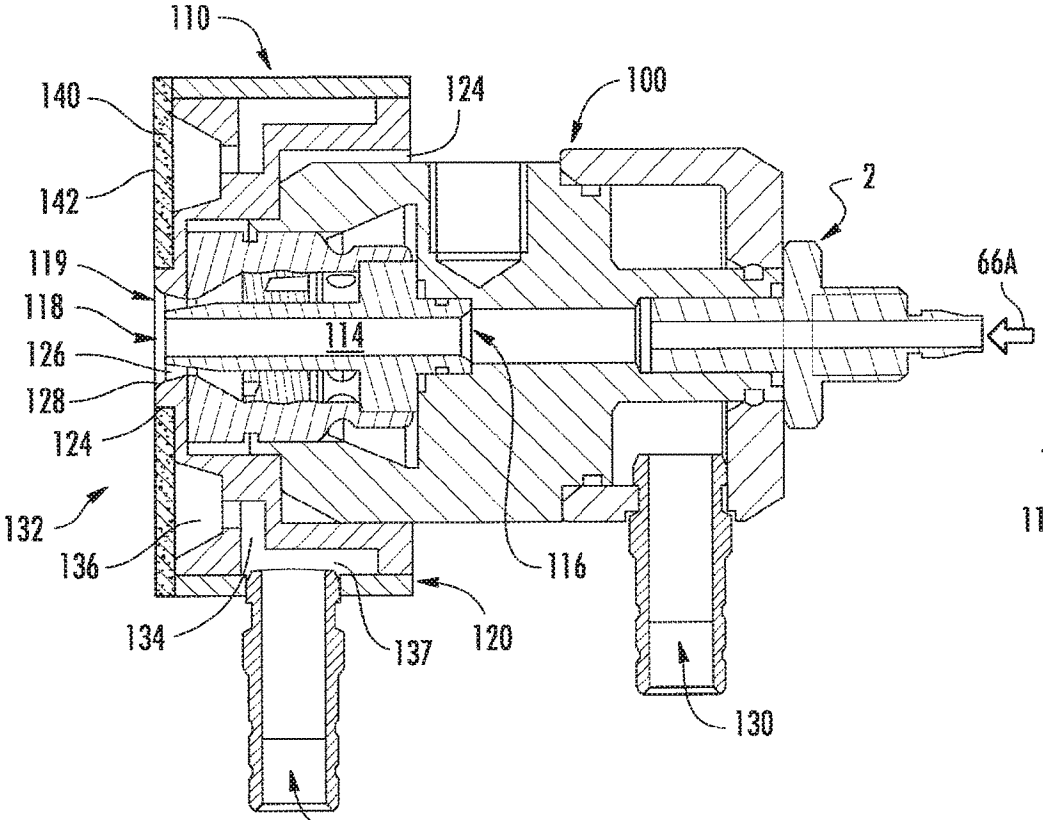

Referring now to FIGS. 7A-7C, in a fourth embodiment, a nozzle adaptor unit 110 is provided that can provide the benefits of the present invention to virtually any nozzle, including those that do not use motive air for process liquid dispersion. The nozzle adaptor unit 110 is structured and arranged to be located in surrounding engagement with a nozzle assembly 100 which may either be an air & liquid type such as described previously, or a high pressure liquid nozzle, either of which may be used in the application of an atomized fluid in a papermaking process. The adaptor unit 110 includes an adaptor body 120 in which is located a nozzle assembly receptacle opening 121 that is preferably adapted for a close surround fit over the nozzle assembly 100, without interfering with the outlet 118. The adaptor 110 is separately supplied with a fluid, such as a cleaning solvent, or a gas such as steam, damp or humid air, or ambient air, via an inlet 105. The fluid delivered via the inlet 105 is directed to air inlet 137 and then to an outside channel 139 in the adaptor body 120 that is in fluid communication with a preferably annular pathway 136 and is delivered from there to a porous disk 140 located in surrounding relation to an opening 119 that is adapted to surround the nozzle outlet 118 where it provides a low velocity fluid discharge through porous the surface 142. A radiused surface 128 is provided on the adaptor body 120 about the opening 119. The radiused surface 128 promotes a radially outwardly expanding flow to the porous surface 142 of the porous disk 140, keeping this transition area free of deposits.

The opening 119 is sized to accommodate the spray outlet 118 which includes a liquid flow path 114 of the nozzle assembly 100. As mentioned, the nozzle adaptor 110 is provided with a separate source of motive fluid shown diagrammatically as provided through the fluid path 130. During operation, a process liquid is delivered from an outside source such as 66A to a coupling 2 attached to the nozzle assembly 100 via inlet 116 to a liquid flow path 114.

The adaptor unit 110 allows for retrofitting of a wide variety of nozzles with the features of the self-cleaning face of the present invention, including nozzles which were not originally constructed to incorporate the self-cleaning face technology according to the invention, including, but not limited to, nozzles that do not use motive air for process liquid dispersion. In this embodiment, as in the third embodiment shown in FIG. 6, it is possible to provide a fluid (such as a liquid cleaning agent) or a gas (such as air, steam, or damp/humid/ambient air) to the porous disk 140 separately from any motive air that may be provided to disperse process liquid. Such fluid can be provided as needed to the porous disk 140 as it is separately supplied.

Figure 8:
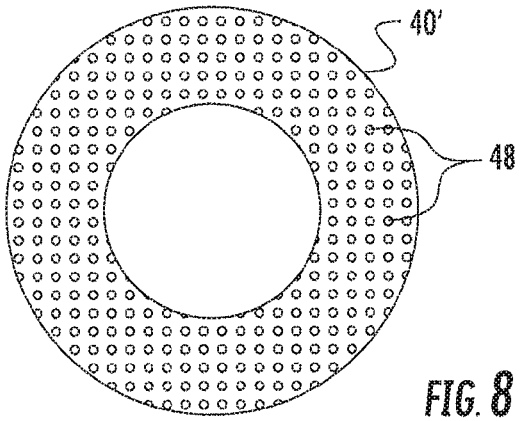
FIG. 8 is an illustration of the surface of a porous disk utilized in the self-cleaning nozzle embodiments of the invention.

FIG. 8 is a planar depiction of a first alternative porous disk 40' such as would be suitable for use in a nozzle assembly 10, 10', 10" or in a nozzle adaptor unit 110 including a porous disk. Porous disk 40' has a planar outer surface which is roughened to provide a surface roughness of between 1 to 500 μm (microns) and further includes a plurality of micro-perforations such as 48.

Figure 9:
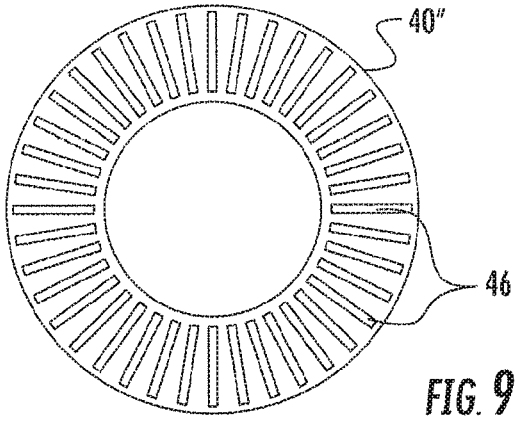
FIG. 9 is a representation of an alternate embodiment of a porous disk that may be utilized in the self-cleaning nozzle embodiments.

FIG. 9 is a planar depiction of a second alternative porous disk 40" which may also be suitable for use in nozzle assembly 10, 10' or 10" according to a first, second or third embodiment of the present invention, or in a nozzle adaptor unit 110 including a porous disk. Porous disk 40" includes a plurality of slotted openings 46 and has a planar outer surface which is roughened to provide a surface roughness of between 1 to 500 μm (microns). Those skilled in the art will understand from the present disclosure that the porous disk 40, 40', 40" can take other forms, and the term "porous" covers any perforated, slotted, foraminous, or otherwise fluid permeable material through which air or other fluid, for example, as delivered via the outside channels 39 to the annular pathway 36 can pass in a controlled manner in order to provide a flow of air or other fluid to the end face 34 surrounding the spray outlet 18 and the gas discharge outlet 26.

Figure 11A:
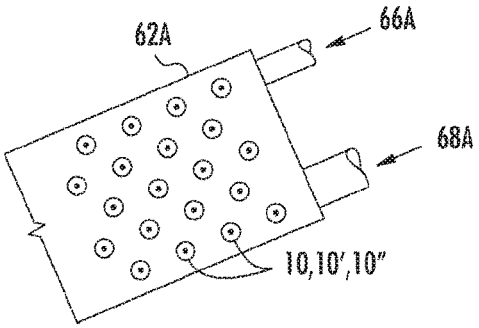
FIGS. 11A and 11B are representations of a nozzle housing including a plurality of self-cleaning nozzles according to the embodiments of the invention.

FIG. 10 is a schematic representation of a spray assembly 60 in a papermaking or similar process machine (not shown) including a plurality of self-cleaning nozzles 10, 10', 10" constructed according to the embodiments of the invention previously presented. During operation, sheet 80 proceeds through spray assembly 60 including housing 62*a*, 62*b* from an upstream to a downstream direction as indicated by paper sheet path 76. The spray assembly 60 includes two banks or sets of nozzles 10, 10', 10" arranged so as to spray process liquid onto opposing planar surfaces of the sheet 80. The individual nozzles 10, 10', 10" in each opposing bank of nozzles may be arranged in any desired manner, but are preferably arrayed in a series of successive cross-machine direction (CD) rows as shown in FIG. 11A (in which the nozzles in one row are offset from those in a successive row) or 11B (where the nozzles are arranged as a regular array of rows and columns). Process liquid such as a fluid starch suspension is delivered to each nozzle 10, 10', 10" via liquid feed paths 70A, 70B which are in fluid communication with liquid chambers 66A, 66B. Fluid such as a pressurized gas, damp air or ambient air is likewise delivered to nozzles 10, 10', 10" via fluid air paths 72A, 72B. As sheet 80 enters the spray apparatus 60 it passes beneath the nozzles 10, 10', 10" which deliver a finely atomized spray of process liquid to one or both planar surfaces of the sheet; the process liquid is uniformly deposited onto the surface as a coating 82. The sheet 80 then exits the assembly 60 and proceeds downstream through a nip formed by a pair of opposing rolls 78 where the coating 82 is smoothed and the sheet surface made as uniform as desired.

FIG. 11A presents a first arrangement of nozzles 10, 10', 10" such as would be used in a spray assembly 60; in FIG. 11A the nozzles in each successive downstream row are offset in relation those in a preceding upstream row.

Figure 11B:
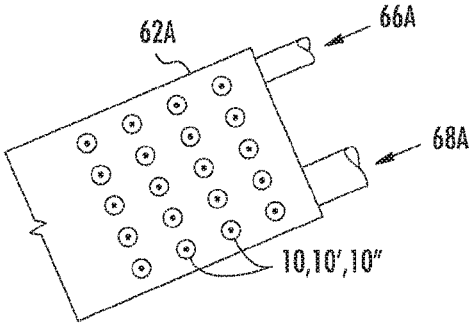

FIG. 11B presents a second arrangement of nozzles 10, 10', 10" such as would be used in a spray assembly 60; in FIG. 11B the nozzles are arranged in a regular array of rows and columns.

Figure 12:
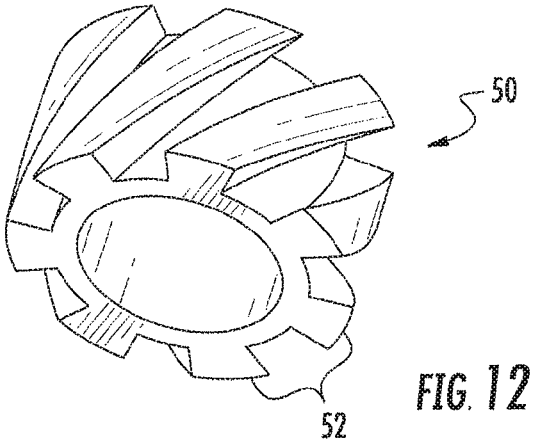
FIGS. 12, 13 and 14 are views of a preferred embodiment of a stator used in connection with the first, second and third embodiments of the self-cleaning nozzle assembly.
Figure 13:
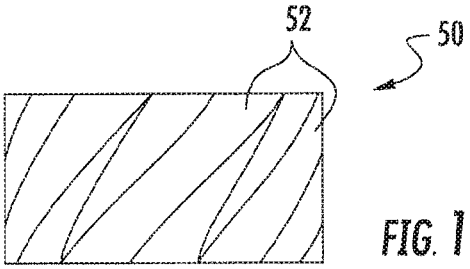
Figure 14:
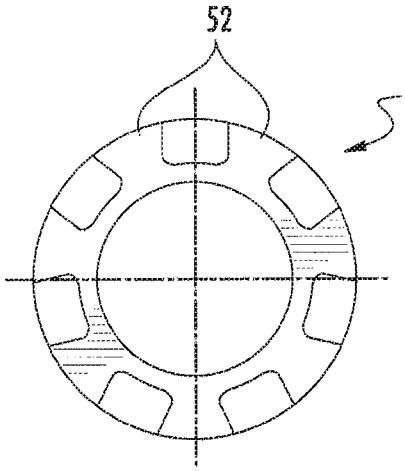

FIG. 12 provides a perspective view of a stator 50 such as would be suitable for use in the nozzles such as 10, 10' and 10" discussed above in relation to the embodiments of the invention. FIG. 13 is a top view looking down onto the stator 50 shown in FIG. 12, while FIG. 14 is provides a cross-sectional view of stator 50. As previously discussed, the motive gas in the form of a pressurized gas, damp or ambient air, is directed into external openings of the air path 30 which are located around the circumference of carrier body 20 of nozzles 10, 10' and 10". At least a portion of this gas then passes through the stator 50 which includes a plurality of angled guide vanes 52, each oriented angularly to the flow direction so that the gas is caused to rotate, or spin, as it exits stator 50 to annular gas flow channel 24. The rotary movement imparted to the motive gas as it exits the stator 50 continues as the gas moves into the annular gas flow channel 24.

As noted above, the channel 24 is shaped so as to decrease in cross-sectional area, and thus volume, as it progresses from the stator 50 towards the radiused surface 28. As the compressed gas moves outwards over the surface 28 it expands rapidly in a somewhat explosive manner which, along with the rotary motion imparted by the angular vanes of the stator 50, produces an outcome similar to the known Bernoulli or Coanda type effects. This causes complete atomization and dispersion of the process liquid as it exits the nozzle at the spray outlet 18. Process liquid delivered to the spray outlet 18 is thus directed away from the outlet 18 and the porous surface 42 of the porous disk 40. The nozzle face is self-cleaning in that low velocity fluid discharge through the disk 40 directs and removes any ambient particulate matter or fluid droplets away from the vicinity of the discharge end 32 so that they do not otherwise coalesce, while the Bernoulli or Coanda swirl effect disperses the fluid and directs it to the moving paper sheet towards which it is directed.

The porous disk 40, 140 is preferably made from one of either a ceramic material or a sintered metal such as stainless steel. If ceramic, one suitable material has been found to be Pall Carbo filter element type 30 available from Pall Corp. If made from metal, a filter such as is available from GKN Sinter Metals GmbH under designation SIKA-R 1.4404 appears to be satisfactory. The liquid flow path 14 is preferably formed from one of either stainless steel coated with Teflon® [PTFE—polytetrafluoroethylene], or polyetheretherketone (PEEK) or other low surface energy polymer. The stator 50 may be comprised of PEEK, brass or other metal or polymer material as may be suitable depending on the intended end use. The carrier body 20 including the tool engaging surfaces 22 may be formed from stainless steel, PEEK or other materials as may be suitable depending on the intended end use.

Use of one of either a metal or ceramic material in porous disk 40, 140 including end face 42 may be dictated by the type of environment and end use application in which the nozzle assembly is to be used. For example, if it is anticipated that the liquid to be sprayed onto the moving web and supplied to the nozzle will be "hot" (e.g.: at or near 100° C., for example) it may be preferred to use a ceramic material such as described above and which is available from Pall Corp. The ceramic material may be somewhat insulated from the temperature of the liquid and will thus tend to remain relatively cooler during operation, thereby inhibiting deposition of suspended materials such as starch in the liquid supplied to the nozzle. On the other hand, if the liquid is anticipated to be "cooler" (e.g. <100° C., for example) either the aforesaid ceramic, or a sintered metal material such as is available from GKN Sinter Metals GmbH may prove satisfactory.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

KEY TO REFERENCE NUMERALS

1, 1' Nozzle Housing
2 Coupling
3 Source of Motive Air
10, 10', 10" Nozzle Assembly
12 Nozzle Body
14 Liquid Flow Path
16 Inlet
18 Spray Outlet
20, 20' Carrier Body
22 Tool Engaging Surfaces
24 Annular Gas Flow Channel
26 Gas Discharge Outlet
28 Racliused Surface
30 Air Path
31 External Fluid Inlet
32 Discharge End
34 End Face
36 Annular Pathway
37 Fluid Inlet (to outside channel 39)
38 Radial Channels
39 Outside Channels
40 Porous Disk
42 Porous Surface
46 Slotted Openings
48 Micro-perforations
50 Stator
52 Vanes
60 Spray Assembly
62A,B Housing
66A,B Liquid Chamber
68A,B Fluid Chamber
70 Liquid Feed Paths
72 Fluid (air) feed paths
74 Cleaning Fluid Supply
76 Paper Sheet Path
78 Pinch Rolls
80 Paper Sheet
82 Coating
86, 86' Manifold
Nozzle Adaptor Parts
100 Nozzle Assembly (other types)
105 Nozzle Adaptor Inlet (for liquids, gas, or cleaning solvent)
110 Nozzle Adaptor unit
114 Liquid Flow Path
116 Inlet
118 Spray outlet
119 Opening
120 Adaptor Body
121 Nozzle Adaptor Assembly Receptacle opening
124 Annular gas flow channel
126 Gas Discharge Outlet
128 Racliused Surface
130 Fluid Path
132 Discharge End
136 Annular Pathway
137 Air Inlet
137 Fluid Inlet (to Outside Channel 139)
139 Outside Channel
140 Porous Disk (for Adaptor 110)
142 Porous Surface (of disk 140)

The invention claimed is:

1. A nozzle assembly with a self-cleaning face, comprising:

a nozzle body with a liquid flow path defined therethrough having an inlet and a spray outlet, wherein the spray outlet is configured to spray a liquid out from the nozzle assembly;

a carrier body that surrounds the nozzle body;

an annular gas flow channel between the nozzle body and the carrier body, the annular gas flow channel including a gas discharge outlet that is radially outward of and encircles the spray outlet;

a porous surface attached to the carrier body, facing outward of the nozzle assembly and in fluid communication with the annular gas flow channel, wherein the porous surface encircles the gas discharge outlet and has an inner perimeter that is radially outward of the gas discharge outlet;

a gas pathway extending through the porous surface, the gas pathway configured to convey a pressurized gas through the porous surface, such that a low velocity flow of the pressurized gas is discharged from the porous surface;

a radiused surface forming an annular outer surface of the gas discharge outlet, wherein the radiused surface is between the gas discharge outlet and the porous surface; and a stator in the annular gas flow channel that includes guide vanes oriented at an acute angle with respect to an axis of the annular gas flow channel.

2. The nozzle assembly of claim 1, wherein the porous surface is formed by a disk located in an end face of the carrier body, and the end face has an opening forming the gas discharge outlet and an inner surface of the opening forms the radiused surface.

3. The nozzle assembly of claim 1, wherein the gas pathway extends from the annular gas flow channel to the porous surface.

4. The nozzle assembly of claim 1, wherein the porous surface is part of a porous disk attached to a discharge end of the carrier body, and the disk is formed from at least one of a sintered material, a ceramic material, or a rigid porous medium.

5. The nozzle assembly of claim 4, wherein the disk is connected to the carrier body via at least one of an adhesive or a positive fit connection.

6. The nozzle assembly of claim 1, wherein the porous surface has a surface roughness of from 1 μm to 500 μm.

7. The nozzle assembly of claim 1, wherein the spray outlet of the nozzle body is recessed within an opening in a discharge end of the carrier body, and the opening forms the gas discharge outlet.

8. A spray assembly for a liquid comprising:

a liquid chamber adapted to contain liquid to be sprayed;

a gas chamber adapted to contain pressurized gas;

a plurality of nozzles connected to the gas chamber, each of the nozzles including:

a nozzle body with a liquid flow path defined therethrough having an inlet and a spray outlet, the inlet being in fluid communication with the liquid chamber and the spray outlet configured to spray liquid out from the spray assembly;

a carrier body in which the nozzle body is mounted;

an annular gas flow channel between the nozzle body and the carrier body, the annular gas flow channel having an annular gas discharge outlet encircling and radially outward of the spray outlet, wherein the annular gas flow channel is in fluid communication with the gas chamber and the annular gas discharge outlet is configured to discharge gas adjacent the liquid sprayed from the spray outlet;

a porous surface having an inner perimeter that encircles and is radially outward of the gas discharge outlet, wherein the porous surface is included in a gas path through which the pressurized gas flows through the porous surface and discharges from the porous surface as a low velocity gas flow;

a radiused surface formed in the carrier body around the gas discharge outlet, wherein the radiused surface is between the porous surface and the gas discharge outlet, and a stator in the annular gas flow channel that includes guide vanes oriented at an acute angle with respect to an axis of the annular gas flow channel.

9. A method of spraying a liquid on an object, comprising:

providing a spray assembly including a liquid chamber for liquid to be sprayed;

providing at least one nozzle including a nozzle body with a liquid flow path defined therethrough having an inlet and a liquid spray outlet, the inlet being in fluid communication with the liquid chamber, wherein the nozzle body is seated in a carrier body; an annular gas flow channel between the nozzle body and the carrier body and the annular gas flow channel having an annular gas discharge outlet encircling the spray outlet; a porous surface having an inner perimeter that encircles and is radially outward of the annular gas discharge outlet, and a radiused surface forming an annular outer surface of the gas discharge outlet and the radiused surface is encircled by and radially inward of the porous surface;

spraying the liquid from the liquid spray outlet, wherein the liquid flows from the liquid chamber through the liquid flow path in the nozzle body to the liquid spray outlet;

simultaneously with the spraying from the liquid spray outlet, discharging the pressurized gas from the annular gas discharge outlet, wherein the discharged pressurized gas is discharged adjacent the spray of liquid from the liquid spray outlet and the discharged pressurized gas expands outwardly over the radiused surface and over the porous surface; and simultaneously with the spraying from the liquid spray outlet, discharging from the porous surface a low velocity flow of gas wherein the low velocity flow is formed from the pressurized gas flowing from source of the pressurized gas and flows through the porous surface.

10. The method of claim 9, wherein the liquid is a heated liquid and the porous surface is formed of a stainless steel material.

11. The method of claim 9, wherein the porous surface is formed of a heat insulating material.

12. A nozzle assembly comprising:

a nozzle body including a liquid flow passage having an inlet and a spray outlet, wherein the spray outlet is configured to spray liquid flowing from the liquid flow passage out from the nozzle assembly;

a carrier body into which is inserted the nozzle body, the carrier boding includes a gas flow channel having an annular gas discharge outlet encircling and radially outward of the spray outlet;

an annulus having an inner perimeter extending around and radially outward of the gas discharge outlet, wherein the annulus is porous, has a first side facing a gas pathway configured to receive a pressurized gas and a second side, opposite to the first side, facing away from the carrier body and forming a portion of an outer surface of the nozzle assembly, wherein the annulus is configured such that the pressurized gas will flow through pores in the annulus and be discharged from the second side as a low velocity flow of the pressurized gas;

an annular surface on the carrier body defining an outer perimeter of the annular gas discharge outlet wherein the annular surface is curved in a direction of an axis of the carrier body, and the annular surface is between the annulus and the annular gas discharge outlet; and a stator mounted in the carrier body and in the annular gas flow channel, the stator includes guide vanes oriented at an acute angle with respect to the axis of the carrier body.

* * * * *